US006484424B1

(12) United States Patent
Peterson

(10) Patent No.: US 6,484,424 B1
(45) Date of Patent: Nov. 26, 2002

(54) VERSATILE BADGE PLATE WITH A JEWELRY-LIKE APPEARANCE

(75) Inventor: James Peterson, Manitowoc, WI (US)

(73) Assignee: Contemporary, Inc., Manitowoc, WI (US)

( * ) Notice: Subject to any disclaimer, the term of this patent is extended or adjusted under 35 U.S.C. 154(b) by 0 days.

(21) Appl. No.: 09/054,222

(22) Filed: Apr. 2, 1998

(51) Int. Cl.[7] ..... A44C 3/00; G09F 3/12
(52) U.S. Cl. ..... 40/1.5; 40/668
(58) Field of Search ..... 40/1.5, 1.6, 661.04, 40/661.05, 661.11, 668; 63/18, 20

(56) References Cited

U.S. PATENT DOCUMENTS 2,213,449 A * 9/1940 Mungen ..... 40/1.5 X
2,232,060 A * 2/1941 Foster ..... 40/1.5
2,341,467 A * 2/1944 Nedell ..... 40/1.5
2,411,987 A * 12/1946 D'Antonio ..... 40/1.5
5,191,682 A * 3/1993 Davis-Reardon et al. .. 40/1.5 X
5,212,899 A * 5/1993 Fandreyer ..... 40/661.11
5,269,485 A * 12/1993 Dwinell et al. ..... 40/688 X

FOREIGN PATENT DOCUMENTS

FR 2694483 * 2/1994 ..... 40/1.5

* cited by examiner

*Primary Examiner*—Brian K. Green
(74) *Attorney, Agent, or Firm*—Michael Best & Friedrich, LLC

(57) ABSTRACT

A relatively low cost assembly—especially one having a jewelry-like appearance—provides for a do-it-yourself display of graphic material while enabling a user to employ modern devices for generating the graphics, such as personal computers with graphic capabilities, special printers, and the like. The assembly includes a front plate and a back plate with a wire spring pin trapped between them. The graphics are on a name plate mounted in a recessed area surrounded by a frame on the front plate. Alignment contours are formed in the front plate to assist the do-it-yourselfer in installing his homemade graphics on the assembly.

12 Claims, 4 Drawing Sheets

VERSATILE BADGE PLATE WITH A JEWELRY-LIKE APPEARANCE

This invention relates to plates, especially ones with a jewelry-like appearance, and more particularly—but not exclusively—to name plates or badges, wall plaques, or the like, and still more particularly to versatile plates which may be customized by or on behalf of the end user, especially in order to use modern printing techniques.

Reference is made to U.S. Pat. Nos. 3,940,864; 4,047,996; 4,125,665; 4,267,224; 4,459,772; 4,497,248; 5,305,538 and 5,398,435 for a disclosure of related subject matter.

The products shown in these and similar patents include name badges, name plates, easels, and the like (hereinafter collectively called "Badges" or "Do-It-Yourself Badges"). Any suitable material may be used to make the inventive badge. However, at the present, either metal or plastic is the preferred material. At least some of the inventive products may be designed to use specific plastic materials in order to make a plastic plate which has a jewelry-like appearance.

Since the disclosures in the above cited patents were originally made, newer equipment and techniques have been developed to improve the printing of graphics and to reduce the cost thereof. For example, modern personal computers give the possibility of being a graphic designer, thereby enabling a creation of badges ranging from the mundane to relatively great art. Accordingly, the end user may now quickly and easily customize his own do-it-yourself badge design simply by doing a little work at a personal computer or other machines such as newer types of printers.

These newer equipments and techniques have opened the possibility that, printing, appearance, convenience, cost and the like, may be provided by the end user, himself, at his own option and with his own do-it-yourself design. No longer is he required to accept only that which is offered to him by a manufacturer or by equipment having relatively limited capabilities. Examples of the newer techniques are laser printing, thermal transfer, laser engraving, rotary engraving, thermal debossing, silk screening, and the like. Other standard office machines have an inked ribbon which a hot type face may press onto a surface in order to transfer the image of the typeface by melting the ink onto a substrate. There are now many different types of label materials, some of which provide unique surface treatments and appearances.

Extremely thin plastic plates are formed by laminated strips of two or more colors. When the top layer is cut away by, as by a laser beam, a rotary cutter, or the like, the color of the underlying strip is displayed against the color of the overlaying strip. While two laminated color strips, per se, are old, the presently available thin plates and the modern cutting techniques are new, opening the way for new and greatly improved treatments.

Other of the newer equipment, printing techniques, and other machines will readily occur to those who are skilled in the art.

Accordingly, an object of the invention is to provide a badge which can enable a use of the newer office machines, equipment, and printing techniques at the user's option. Here, an object is to provide, not only for newer equipment, but also to continue accommodating the conventional equipment and techniques that are used when making the existing badges. A further object is to provide a system which enables a hybrid of user designs mounted on a manufacturer's platform.

In keeping with an aspect of the invention, these and similar objects are accomplished by providing a front plate having a recessed area surrounded by an upstanding frame.

The frame is high enough above the recessed area to prevent a scuffing and peeling of the name plate, especially at the edges of the name plate. The frame also serves as a guide for aligning the emplacement of the name plate in the badge. This alignment is of special value when it is desirable to place two or more layers in the same recess, such as a paper label covered by a transparent layer giving an impression of graphics embedded in plastic and also when the name plate is not a rectangular shape. A low-cost back plate and wire spring combination provides a stable pin back for securing the badge to clothing. The invention also contemplates a use of other fasteners such as "Velcro" hook and loop, magnetic, pin backs, and military (nail and clutch), and the like.

The invention will become more apparent from a study of the following specification, taken with the attached drawings, in which.

Figure 1:
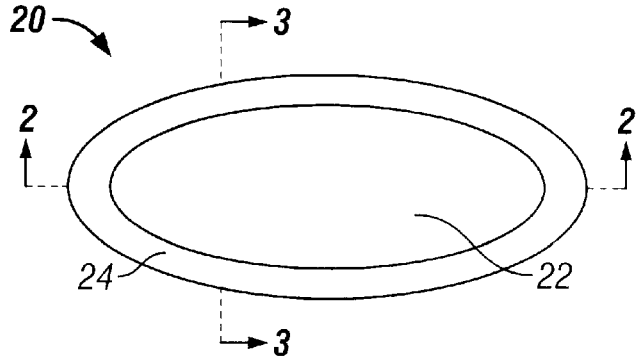
FIG. 1 is a plan view of a front plate having a recessed area surrounded by an upstanding fence which provides graphic alignment contours.
Figure 2:
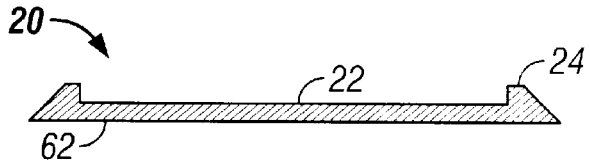
FIG. 2 is a cross section taken along line 2—2 of FIG. 1.

FIG. 1 is a plan view of a front plate 20 having an upper surface containing a recessed area 22 surrounded by an upstanding fence 24. The recessed area and fence together forming an open topped frame that provides alignment contours which assist the do-it-yourselfer when he assembles the badge. The material preferably has an appearance of fine jewelry. In one embodiment, the plate 20 is a highly polished metal and in another embodiment it is a molded plastic material, again having a high quality appearance. However, it is within the invention to provide other treatments, such as an engraved surface on frame 24, company names, symbols, or logos. A heavily inked line (FIG. 2) represents an adhesive, preferably a pressure sensitive adhesive, on the back of the front plate 20. However, it should be understood that any of many glues, adhesives and the like may be used.

The fence forming frame 24 stands high enough above the recessed area 22 to project slightly above an insert 30 (FIG. 6), such as a name plate. The frame 24 protects not only the upper surface, but protects the edge of the name plate against scuffing especially when the name plate has an upper transparent layer 32 (FIGS. 3C and 7B) which can be peeled off. Many inserts other than name plates could also be used, such as cards which change color in the presence of a gas or radiation, for example. For convenience of expression, all of these and other similar inserts will hereinafter be called, "name plates".

Figure 4:
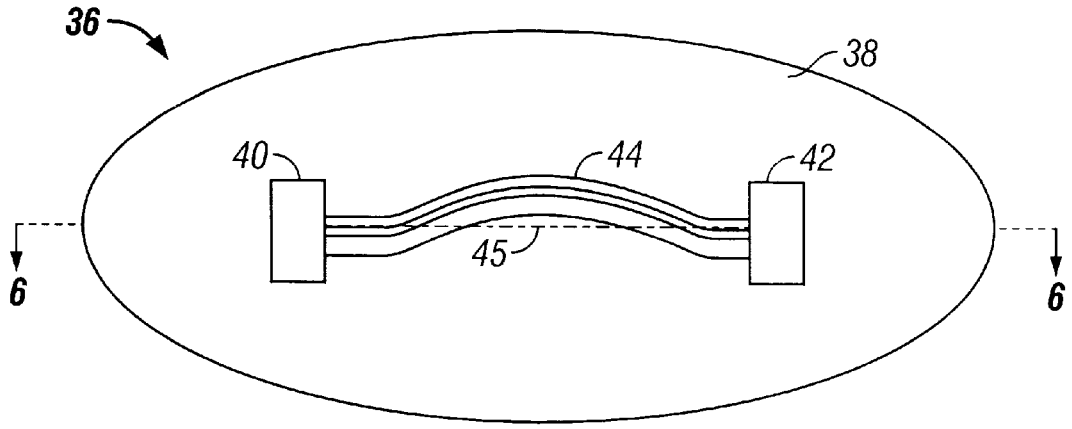
FIG. 4 is a plan view of a backing plate used in connection with the front plate of FIG. 1.

FIG. 4 is a plan view which shows a backing plate 36, preferably used with a bent wire spring forming a pin at the back of the badge. Plate 36 has a flat upper surface with spaced holes 40, 42 joined by a stabilizing groove 44, which may be somewhat arcuate. In other embodiments, groove 44 may take any convenient shape which provides stability, such as an "S" curve, for example. Preferably, at least some portion of groove 44 should be displaced from a straight line 45 joining holes 40, 42 in order to give a vertical stability to the pin 46. If desired, the holes 40,42 may be located in other suitable locations. For example, an oddly shaped badge (such as a cartoon character, lion rampant, etc.) might have a unique requirement in order to make the badge hang right.

Figure 5:
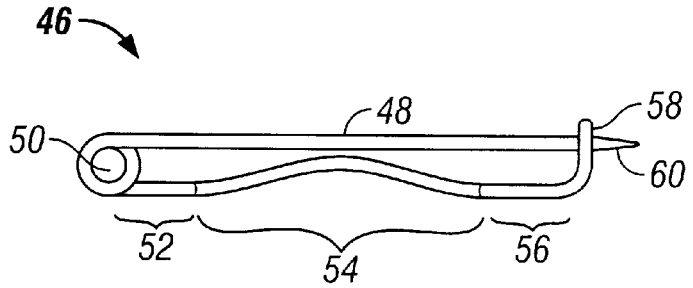
FIG. 5 is a perspective view which shows a low cost wire spring pin, which is bent to shape.

FIG. 5 is a perspective view of a pin 46 formed by bending a wire spring. The pin has a bent profile 52–56 in a horizontal plane and an upstanding spring bend 50 and hook 58 in a vertical plane. In greater detail, the pin has a bar 48, pointed on one end 60, which may be threaded through any suitable fabric, or the like, in order to mount the badge on a garment, for example.

At 50, the wire spring bends back upon itself to form a spring section which is reminiscent of a corresponding part of a safety pin. From there, the wire spring has a profile in a horizontal plane which preferably begins with a somewhat straight section 52 which facilitates an installation of the pin through hole 40 on the backing plate 36. Next, the wire spring forming the pin has an arcuate stabilizing section 54 in a horizontal plane, the arcuate section being the same shape as the arcuate stabilizing section of groove 44. If stabilizing groove 44 should have some other shape, such as "S", the arcuate pin section 54 would also have a similar "S" shape in its horizontal plane.

At the end of arcuate shape 54, the wire spring 46 has a straight section 56, again to facilitate an insertion of hook 58 through hole 42 back plate 36. The wire spring ends in an upstanding hook 58 for receiving and capturing the end 60 of the pin bar 48. Other findings may be used in place of pin 46. For example, there could be a snap, a clip, a jump ring, "Velcro" hook and loop fasteners, a magnetically held back, a military fastener using a nail and clutch, a pendant, or the like.

Figure 6:
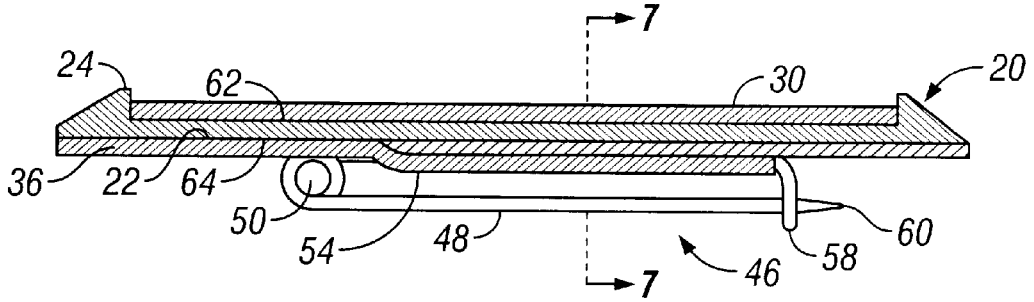
FIG. 6 is a cross section, which show a completed badge.

FIG. 6 shows an entirely assembled badge. Heavily inked lines 62 and 64 indicate any suitable glue or adhesive, preferably pressure sensitive adhesive layers. If a pressure sensitive adhesive is used, then before the badge is assembled, these adhesive layers are covered by a release paper. Of course, the adhesive may be on either the name badge or one of the other plates.

The first step depends upon how the name plate 30 is made. Usually, the name plate 30 is very thin, being about as thick as a post card or a business card. It the could be a debossed plastic plate having a surface appearance which appears to be an integral part of the polished front plate 20. It could also have any of the many decorative surfaces of modern plastics. For example, it could appear to be made of marble, wood, leather, or the like.

The release paper (not shown) is peeled away and the adhesive layer 62 on the back of the name plate 30 is pressed against recessed area 22 in the front plate 20. Since the pressure sensitive adhesive takes its bite on contact, it has heretofore been difficult to properly align the name plate 30 on the front plate 22 because the alignment has to be correct when the adhesive first touches the front plate. However, with the alignment contours provided by the upstanding fence of frame 24, it is a simple matter to cause an end or side of the name plate to be abutted against an inside edge of the frame before pressure is applied to adhere the name plate to the depressed area. Therefore, with the upstanding fence it is much easier to align the name plate on the inventive face plate—especially when the badge is an irregular shape, such as an oval, for example.

Figure 8:
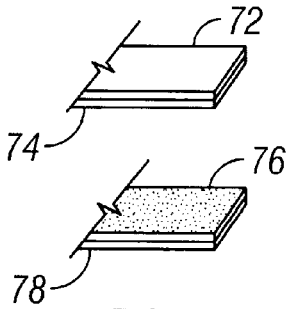
FIG. 8 is a perspective view of a transparent tape and textured strip which may be used to make a name plate.

The U.S. Pat. Nos. 5,9398,435 and 5,305,538 show a type of name plate where a Brother "P-Touch" printer is used to print the graphics. In effect, this printer prints graphics on the back of a thin transparent pressure sensitive tape 70 (FIG. 3B) or 72 (FIG. 8). That tape is then pressed down over a textured surface having communicating passage ways for enabling air to escape from behind the tape. Again, an adhesive layer is indicated by heavily inked line 74.

The "P-Touch" printers are able to print tape in any of many different widths, which may be selected to fit into the width of the depressed area 22. According to an aspect of the invention, the surface of depressed area 68 (FIG. 3B) may be textured. Hence, the tape 70 produced by the "P-Touch" printer may be installed directly against the recessed area 68 on the front plate 20.

Figure 3A:
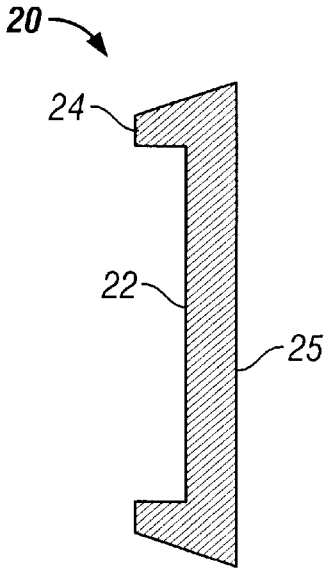
FIGS. 3A–3C are cross sections of three combinations taken along line 3—3 of FIG. 1.
Figure 3B:
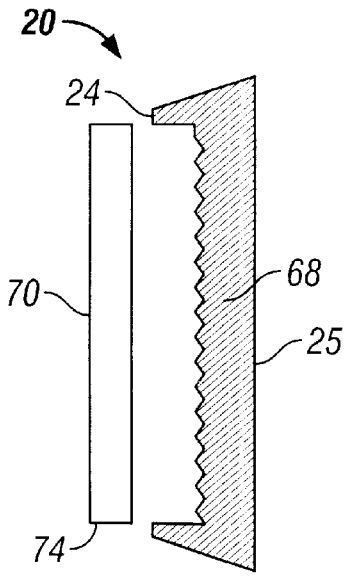

It is also within the scope of the invention to provide a separate textured tape 76 (FIG. 8). Sometimes it is easier to apply the "P-Touch" printer tape to the separate textured tape 76 and then to apply the resulting combination of tapes 72, 76 to the depressed area 22 (FIG. 3A). Pressure sensitive adhesive is indicated by heavily inked line 78.

Figure 7A:
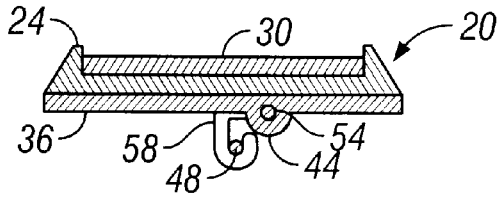
FIGS. 7A and 7B are cross-sectional views taken along line 7—7 in FIG. 6 which show a name plate without and with a transparent cover sheet.
Figure 7B:
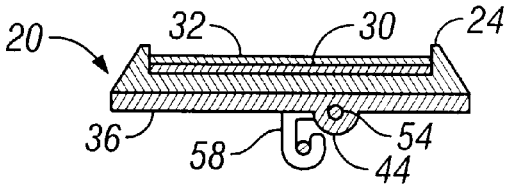

The assembly of the back plate begins with an inversion of backing plate 36 and an insertion of the wire spring pin 46 through the two holes 40, 42. The horizontal stabilizing section 54 is fitted into groove 44. From FIGS. 7A and 7B, it is seen that the arcuate section 54 is offset from the vertical parts 50, 58, which go through holes 40, 42. Hence, the arcuate section 44 behaves somewhat as a foot for giving a stability to the vertical parts 50, 58 of pin 46.

Then, the release paper is peeled away from adhesive layer 64 and the lower surface of the front plate 20 is adhered to the upper surface of the back plate 36, thereby trapping the arcuate section 54 in groove 44 and immobilizing the pin 46 relative to the badge.

Figure 3C:
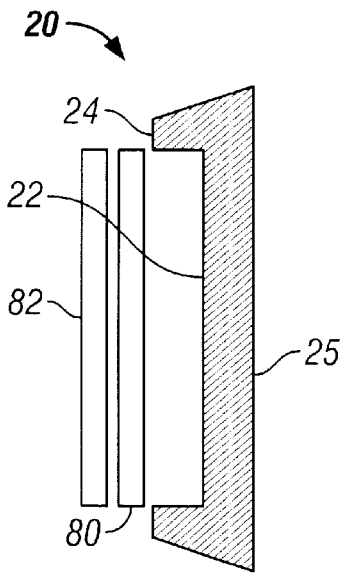

FIG. 3C shows an advantage of the invention. Since the upstanding frame 24 enables an excellent alignment, the customer may provide a do-it-yourselfer label 80 of any suitable type, at his option. This could be a company logo, a typed label (such as one sold under the trademark "Avery", for example), or even a hand drawn picture. The label 80 is fitted into the recessed area 22 with the help of the aligning contours of the front plate frame. Then, another and completely transparent tape label 82 is fitted into the recessed area 22 and over label 80. This gives an appearance of a label sealed in plastic. Again, an adhesive on labels 80, 82 is indicated by heavily inked lines.

Figure 9:
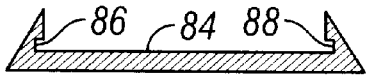
FIGS. 9 and 10 are cross sections of a front plate of a badge where the name plate is held mechanically instead of by an adhesive.

FIG. 9 shows a refinement of the front plate which provides for a mechanical capture of the name plate. In greater detail, front plate 84 has oppositely disposed undercut regions 86, 88 with dimensions corresponding to the dimensions at the ends of the name plate 90.

First, one end 92 of the name plate 90 is inserted into undercut region 86. Then, the name plate is bowed slightly and the opposite end 94 is slipped into the under cut region 88. There is enough clearance in these undercut regions for the name plate 90 (FIG. 10) to be easily installed. However, the clearance is small enough to securely hold the name plate and place. Hence, the name plate is held mechanically instead of by an adhesive. This embodiment is particularly attractive for situations where name plates are used only briefly before being replaced by new name plates.

Figure 10:
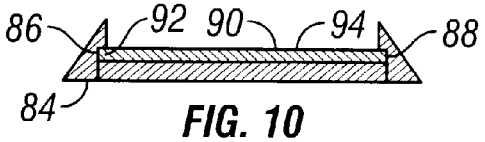
Figure 11:
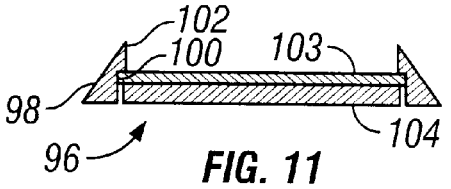
FIG. 11 is a cross-section which shows another mechanical holding means similar to a picture frame.
Figure 12A:
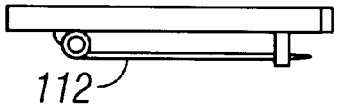
FIGS. 12A–12H show various findings that can be used.
Figure 12B:
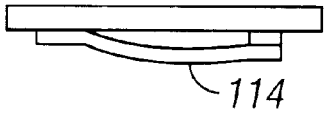
Figure 12C:
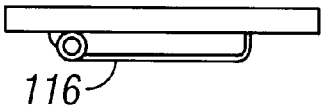
Figure 12D:
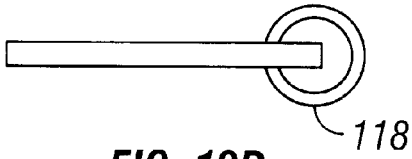
Figure 12E:
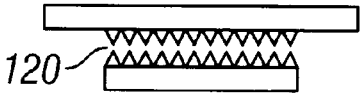
Figure 12F:
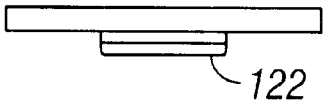
Figure 12G:
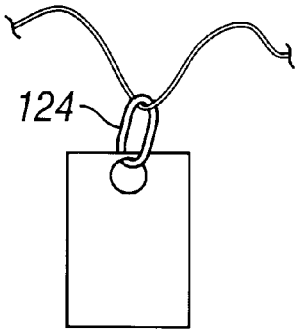
Figure 12H:
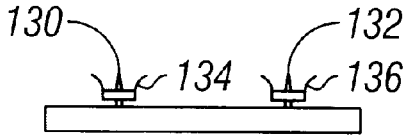

The front plate 96 (FIG. 11) is similar to the front plate 84 of FIG. 10. Here, the front plate 96 is a frame 98 which is open on the back and has an under cut region 100 leaving an upstanding fence 102 which completely surrounds the entire area 22—similar to a picture frame. This means that the name plate 103 is placed in the under cut region 100 surrounding the back of area 22. Thereafter, any suitable member 104 is added to the back surface of the assembly to mechanically secure name plate 22 in place. For example, member 104 may be all or part of back plate 36 (FIG. 6) containing the pin 46; or, it could be a separate plate which is not shown elsewhere in the drawings. It could also be a different kind of a finding, such as one which would facilitate hanging the badge on a chain which encircles a persons neck, for example.

FIG. 12 shows a group of exemplary findings consisting of a pin back 112, a snap 114, a clip 116, a jump ring 118, a hook and loop fastener 120 such as that sold under the trademark "Velcro", a magnetic device 122, a pendant 124, and a military fastener 126. A military fastener has two posts 130, 132 on the back, with clutches 134, 136. A clutch is a familiar fastener most often used on the pin of an earring for pierced ears.

The advantages of the invention should now be apparent. The frame 24 may have a jewelry-like appearance and give a high quality impression. With the current printers, computers, and the like, it is possible for the customer to design very unique and sometimes intricate graphics which may be printed on any of many different kinds of commercially available labels. The customer may buy any of a great variety of name badges; or, he may design and even produce his own name badge. Hence, the invention opens the doors to do-it-yourself individuality not heretofore available.

Those who are skilled in the art will readily perceive modifications which are within the spirit and scope of the invention. Therefore, the appended claims are to be construed to cover all equivalent structures.

What is claimed is:

1. An assembly for displaying graphic material in a Jewelry-like setting comprising a front plate secured in a face-to-face contact with a back plate, said front plate being a single and unitary plate with an upstanding fence projecting therefrom and forming an open topped frame surrounding a recessed area, a pin for fastening said assembly to another object, said pin consisting of a wire spring having a bent profile and an upstanding bend and hook in a vertical plane, a back plate having a groove which is complementary to said profile for receiving and trapping said profile of said pin between said front plate and said back plate, means for enabling said bend and said hook to project from said back plate, said wire spring extending from said bend to a location where it is captured within said hook, and means fitting into said open top of said frame and bonded to said front plate for displaying graphic material in said recessed area, said means for displaying graphic material having a shape with corresponds to a shape of said recess and which fits within and abuts against said frame in order to give the name plate and front plate a unified appearance; and said graphic material having a thickness which is less than a height of said fence forming said frame whereby said frame protects said graphics material from abrasion by objects passing over said open top of said frame.

2. The assembly of claim 1 wherein said assembly is held together by a pressure sensitive adhesive located between said means for displaying graphic material and said recessed area and between said front plate and said back plate.

3. The assembly of claim 2 wherein said recessed area has a textured surface for enabling air to escape when said graphic material means is adhered to said face plate.

4. The assembly of claim 3 wherein said graphic material means is a transparent layer with said graphics on a side which is adhered to said recessed area, whereby said graphic material is seen by looking through said transparent layer.

5. The assembly of claim 2 and a transparent film adhered over said graphic material means.

6. The assembly of claim 2 further comprising a textured strip interposed between said recessed area and said graphic material means, said texture enabling air to escape from between said textured strip and said graphic material means.

7. An assembly for displaying graphics material against a jewelry like background, said assembly comprising a front face plate having an upper surface and a lower surface, said upper surface containing a recessed area surrounded by an upstanding fence to form a frame; a name plate having a graphic material thereon, a transparent layer over and adhered to said graphic material, said name plate having a shape which fits into said frame and substantially fills said recessed area and abuts against said upstanding fence forming said frame, said name plate being adhesively bonded in said recess to give the name plate and front plate a unified appearance, said name plate having a thickness which is less than a height of said fence forming said frame whereby said height of said fence is higher than the combined thickness of said name plate and said transparent layer over said name plate; means including a fastener for associating said assembly with another device; a back plate having an upper surface with means therein for receiving and capturing said fastener means; and means for securing said upper surface of said back plate to said lower surface of said front plate.

8. The assembly of claim 7 wherein said name plate comprises a transparent tape with graphics and a pressure sensitive adhesive layer on the back of said tape, and said recessed area has a textured surface for enabling air to escape from behind said transparent tape when it is adhered into said recessed area.

9. The assembly of claim 7 wherein said transparent layer is secured in alignment by abutment against said fence for covering said graphic material and giving an encased in plastic appearance to said graphic material.

10. The assembly of claim 7 wherein said fastener is selected from a group consisting of a pin, a pin back, a snap, a clip, a jump ring, a hook and loop fastener, a magnetic device, a pendant, and a military fastener.

11. The assembly of any of the claims 1 or 7 wherein said front plate is made of a high quality material selected from a group consisting of a highly polished metal or a molded plastic.

12. The assembly of claim 11 wherein said front plate has a surface with a treatment selected from a group consisting of an engraved surface, a company name, symbol or a logo.

* * * * *